United States Patent [19]

Ruttenberg

[11] 4,360,984

[45] Nov. 30, 1982

[54] PORTABLE IRONING PAD

[76] Inventor: Reid W. Ruttenberg, 1345 Bennington Ave., Pittsburgh, Pa. 15217

[21] Appl. No.: 287,218

[22] Filed: Jul. 27, 1981

[51] Int. Cl.[3] ..... D06F 81/14

[52] U.S. Cl. ..... 38/140; 38/66; 428/71; 428/213; 428/215; 428/311.5; 428/317.1; 428/319.1

[58] Field of Search ..... 38/66, 140; 428/71, 428/213, 311.5, 316.6, 317.1, 317.5, 317.7, 319.1, 215, 311.7

[56] References Cited

U.S. PATENT DOCUMENTS

| | | | |
|---|---|---|---|
| 2,947,098 | 8/1960 | Crockford | 428/138 |
| 3,007,267 | 11/1961 | Goldsmith | 38/140 |
| 3,324,584 | 6/1967 | Adiletta et al. | 38/140 |
| 3,647,609 | 3/1972 | Cyba | 428/423.3 |
| 3,650,867 | 3/1972 | Bauer | 156/183 |
| 3,911,603 | 10/1975 | Lehrman | 38/140 |
| 4,043,062 | 8/1977 | Lehrman | 428/71 |

*Primary Examiner*—William J. Van Balen

*Attorney, Agent, or Firm*—Robert D. Yeager; Olin E. Williams

[57] ABSTRACT

A substantially wrinkle free ironing pad of convenient dimension that can be folded without creasing and carried with luggage and can be placed on a support surface for ironing without either need for an ironing board or risk of harmful effect of heat or moisture on the said surface comprises a central layer of a heat resistant foamed polymer, a layer irreversibly adhered thereon of a highly heat reflective metallized, preferably aluminized, polyester, polyethylene, or nylon film laminate, and a cover of either cotton, a cotton blend, or a synthetic cloth coated with a heat-resistant resin to improve iron glide and scorch resistance.

7 Claims, 2 Drawing Figures

PORTABLE IRONING PAD

BACKGROUND OF THE INVENTION

1. Field of the Invention

This invention relates to an improved ironing pad that can be placed on a flat surface and used for ironing without having to set up an ironing board and is small and flexible enough to be carried in a suitcase or other hand luggage.

2. Description of the Prior Art

The need for means to avoid setting up the conventional ironing board for such casual ironing or pressing in these days of permanent press synthetics has long been recognized, and flexible, relatively small, resilient pads have been devised, as, for example, that of Lehrman U.S. Pat. No. 4,043,062 in which a metal foil is used as a moisture barrier and a thermoplastic adhesive that melts at ironing temperatures (a hand iron is usually heated to about 150° F. to 300° F.) is employed so that upon softening of the adhesive wrinkles in the foil-containing pad will be ironed out and eliminated. In recent years, metal foils have more than doubled in price making them somewhat beyond the reach of convenience items and the continued softening and then hardening of the thermoplastic adhesive limits the life of the pad even before noticeable wear sets in and its ability to smooth out an increasingly wrinkled foil is diminished.

Iron board covers do not have to meet the requirements of being flexible but smooth when spread out for ironing for they are stretched over an ironing board, which forms their shape, and there is of course no need to prevent heat penetration; but such prevention is essential to an ironing pad which may be placed on a table or other surface that can easily be damaged by heat and moisture. Some ironing board covers have incorporated moisture or heat barriers to improve ironing techniques without, however, providing for or even encountering any need for a heat barrier that would protect painted, varnished or lacquered wooden surfaces. These are to be found in the patents Lehrman U.S. Pat. No. 3,911,603, Adiletta et al. U.S. Pat. No. 3,324,584, Crockford U.S. Pat. No. 2,947,098 and to Goldsmith U.S. Pat. No. 3,007,267. In the Goldsmith patent, for example, an applied powdered metal heat barrier is employed solely to reflect heat back to the material being ironed and when a lower ironing temperature is desired this heat barrier is slung beneath the ironing board by a reversal of the cover whereupon the barrier is totally inoperative. In Lehrman U.S. Pat. No. 3,911,603 aluminum flakes are used in an ironing board cover as heat-reflective material (being discontinuous they cannot be a moisture barrier) and, as in the Lehrman (U.S. Pat. No. 4,043,062) pad, a heat-softening adhesive must be used to maintain this combination in wrinkle-free ironable condition.

SUMMARY OF THE INVENTION

A flexible, long wearing, and essentially wrinkle free portable ironing pad that can be used on any conveniently available flat surface without risk of damage to the surface by heat or steam from the iron or the goods being pressed or ironed on the pad is provided by the combination of a pad-shaped layer of a flexible-foam polymer such as polyurethane; and, bonded to the upper surface of the pad of polymer by an irreversibly set adhesive, a laminate consisting of a metallized synthetic-resin film, such as an aluminized polyester film, having at least one highly reflective surface and constituting in combination with the foam polymer a heat reflective and substantially moisture-impervious barrier, the bonded layers pad being preferably covered with a fabric consisting of cotton, a synthetic fabric, or a blend of the two that in any case is coated with a resin to ease the movement of the iron on the cover and render the cover heat or scorch resistant. The aluminized polyester film has a relatively heavy deposit of aluminum of about 100 micrograms per square inch giving it an optical density of between 3 and 3.5.

DETAILED DESCRIPTION OF THE PREFERRED EMBODIMENTS

Figure 1:
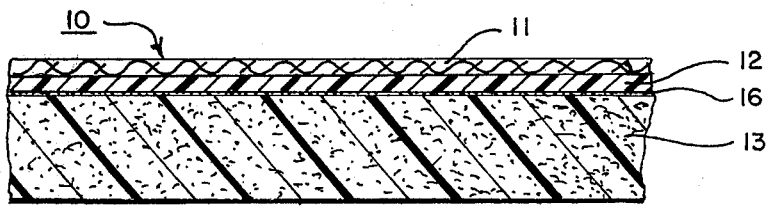
FIG. 1 is a cross-sectional view of a section of the ironing pad of the invention showing the layers constituting the pad.

Referring now to FIG. 1 a cross section of a central portion of the ironing pad, generally designated as 10, illustrates in exaggerated thickness a cover 11 which can be a coated 100% cotton fabric, a heat-reflective moisture barrier 12, and a foamed layer, or body of the pad 13, which can be a polyester foam. The cover 11 can be sewed to the foam layer 13 and barrier layer 12 or it can conveniently consist of a cover 11*a* enclosing these layers, as shown in part in FIG. 2. In either case the cover 11, 11*a*, can be stitched preferably along the periphery to the layers 12 and 13.

The layers 12 and 13 are glued to each other by a thermosetting-resinous glue which forms a glue line 16. It is important that this adhesive not be thermoplastic and that it be impervious to change at ironing temperatures (150° F. to 300° F.) so that under the sliding forces (horizontal friction) of the iron the reflective-moisture barrier 12 will not be dislodged or caused to wrinkle on the foam layer 13. The foam layer 13 being preferably a polyester foam will yield to the pressure of the iron and be squeezed against the supporting surface so as to prevent slippage of the ironing pad 10.

Figure 2:
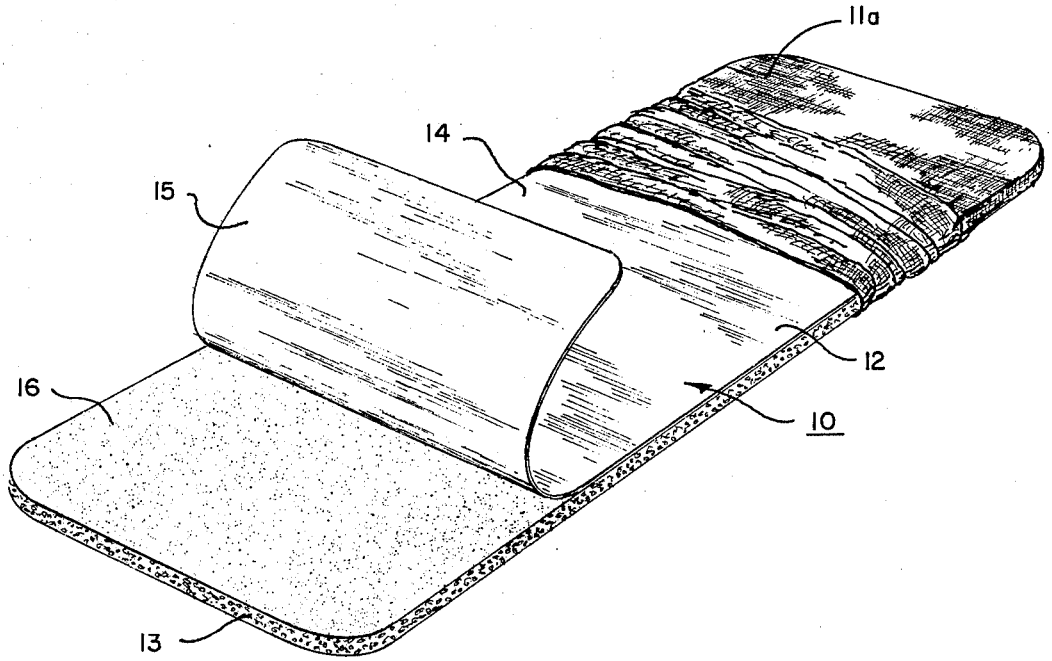
FIG. 2 is a perspective view with layers folded back and cut away further to illustrate the invention.

In FIG. 2 the cover 11*a* which may be of cotton such as a cotton drill (a durable cotton fabric in a twill weave) and is preferably coated with a synthetic resin, such as a silicone resin, to improve its heat resistance and to ease the movement (reduce the friction) of the ironed fabric on the pad, is shown only in part and that part is pulled back to reveal the shiny surface of the heat and moisture barrier 12. The cover 11, 11*a* can also be made of synthetic fabric (usually but not necessarily woven) or of a mixed weave of cotton and a synthetic fabric, wrinkle-resistant mixtures of this type being well known.

The heat and moisture barrier 12 is shown in FIG. 2 folded back from the foamed layer 13 solely to reveal the highly reflective upper and lower surfaces 14 and 15 of the barrier 12. This material, which even without the support provided by the instant combination is and remains substantially wrinkle free (as opposed to the well-known tendency of aluminum foil to crease and wrinkle) consists in its improved embodiment of a film about 0.0005" thick of aluminized polyester. The aluminized layer, in the preferred instance on each surface of the polyester film, contains about 100 micrograms per square inch and exhibits an optical density between about 3 and 3.5 and a square resistance between about 2 and 3 ohms. This high optical density results from an aluminum deposit about 1 mil thick. The use of such laminates in packaging is described in Paper, Film, & Foil CONVERTER of March, 1981, p. 78 entitled *Europe's High Use Of Metallized Materials In High Barrier Laminates.* A trademarked polyester film of uniform high quality and usefulness in the present combination is du Pont's MYLAR.

The foam layer 13 is preferably (for convenience in handling and providing all necessary insulation) about $\frac{3}{8}''$ thick but can be from $\frac{1}{4}''$ to $\frac{3}{4}''$ thick, the thinner layer being possible for use because of the high heat and moisture barrier provided by the MYLAR film. The foam layer in the examples currently used in a polyester-flexible polyurethane being about 1.2 pound per cubic foot and 26 to 34 pounds ILD (compression). This material is skid resistant and will adhere to most surfaces (tables, etc.) available for casual ironing or pressing.

The product of invention as described above will under the conditions of steam ironing, (air saturated with moisture at 150° F. to 300° F.) have a moisture permeability of less than 0.05 grams of water per 100 square inch after 24 hours, or, to relate its permeability to usual casual ironing periods of no more than an hour, of substantially nil.

The configuration of the ironing pad of invention, while usually similar to that shown in the drawings, can vary as convenience dictates, and sleeves or straps can be added to the pad to secure it, for example, to the corner of a table, without departing from the scope of the invention as hereinafter claimed.

What is claimed is:

1. A portable flexible, ironing pad that can be placed on a support surface for ironing without need for an ironing board or risk of harmful effect of heat on the said surface, the said pad comprising:

a layer of heat resistant foamed polymer having an upper and lower surface of major dimension to form a pad-shaped body: adhesively bonded thereto by an irreversably hardened thermosetting adhesive a highly heat reflective moisture impervious laminate consisting of an aluminized film selected from the group consisting of a polyester film, a polyethylene film, a polyester/polyethylene film and a polyester/nylon film, the said film being in the order of 0.005 inches thick and the deposit of aluminum on the said film exceeding but being in the order of 100 micrograms per square inch; and a cover for said laminate consisting of a fabric selected from the group consisting of a woven cotton, a synthetic fabric, and a woven fabric in part of cotton and in part of a synthetic fabric.

2. The ironing pad of claim 1 in which the foamed polymer is a flexible polyurethane.

3. The ironing pad of claim 2 in which the flexible polyurethane is between 1.0 and 1.4 pounds per cubic foot in density.

4. The ironing pad of claim 1 in which the selected fabric is cotton coated with a synthetic resin to ease iron glide and scorch resistance.

5. The ironing pad of claim 1 in which the optical density of the aluminized polyester film is between 3 and 3.5 and exhibits a square resistance of between about 2 and 3 ohms.

6. The ironing pad of claim 1 in which the metallized film consists of an aluminized polyester film having an aluminum layer of between $\frac{1}{8}$ and 1 mil in thickness and a moisture permeability of less than 0.05 grams of water per 100 square inches per 24 hours under conditions imposing steam in contact with the aluminized film.

7. The ironing pad of claim 1 in which the aluminized polyester film is coated on both sides with the aluminum film.

* * * * *

UNITED STATES PATENT AND TRADEMARK OFFICE

CERTIFICATE OF CORRECTION

PATENT NO. : 4,360,984

DATED : November 30, 1982

INVENTOR(S) : Reid W. Ruttenberg

It is certified that error appears in the above—identified patent and that said Letters Patent is hereby corrected as shown below:

Col. 1, line 13, delete "such" and substitute therefor --each--;

Col. 3, line 15, delete the second occurrence of "in" and substitute therefor --is--; and Col. 4, line 10, delete"0.005" and substitute therefor --0.0005--.

Signed and Sealed this

*First* Day of *February 1983*

[SEAL]

*Attest:*

GERALD J. MOSSINGHOFF

*Attesting Officer*

*Commissioner of Patents and Trademarks*